United States Patent [19]

Urakami

[11] Patent Number: 4,984,396

[45] Date of Patent: Jan. 15, 1991

[54] CLEANING DEVICE

[76] Inventor: Fukashi Urakami, Maruyoshi Bldg. 608, 17-24, Konandai 4-chome, Konan-ku, Yokohama, Japan

[21] Appl. No.: 396,967

[22] Filed: Aug. 22, 1989

[30] Foreign Application Priority Data

Aug. 29, 1988 [JP] Japan ..... 63-214536

[51] Int. Cl.[5] ..... B24C 9/00

[52] U.S. Cl. ..... 51/424; 51/429; 51/439; 51/410

[58] Field of Search ..... 51/424, 410, 429, 439, 51/425, 412

[56] References Cited

U.S. PATENT DOCUMENTS

| | | | |
|---|---|---|---|
| 818,776 | 4/1906 | Murray | 51/525 |
| 3,925,935 | 12/1975 | Ricklefs | 51/424 |
| 4,149,345 | 4/1979 | Atsuchi | 51/424 |
| 4,563,840 | 1/1986 | Urakami | 51/410 |

FOREIGN PATENT DOCUMENTS

| | | | |
|---|---|---|---|
| 0196379 | 8/1988 | Japan | 51/424 |

*Primary Examiner*—Robert A. Rose

[57] ABSTRACT

A cleaning device for impinging a cleaning material against a surface to be cleaned. The device comprises a cleaning head having a first nozzle flow passage to be positioned opposite to the surface, a second nozzle flow passage spaced away upstream from the first nozzle flow passage, a re-impinged cleaning material inflow passage and an outflow passage. The cleaning device further comprises means for feeding a pressure fluid stream containing the cleaning material to the second nozzle flow passage, means for sucking a fluid from the outflow passage, and means for returning the cleaning material impinged against said surface from the first nozzle flow passage to the re-impinged cleaning material inflow passage.

5 Claims, 3 Drawing Sheets

CLEANING DEVICE

FIELD OF THE INVENTION

This invention relates to a cleaning device of the type adapted to entrain a cleaning material such as metal particles, ceramic particles or sand in a pressure fluid stream and impinge it against a surface to be cleaned.

DESCRIPTION OF THE PRIOR ART

Cleaning devices of the type adapted to impinge a pressure fluid stream containing a cleaning material such as metal particles, ceramic particles or sand against a surface to be cleaned through a nozzle flow passage disposed in a cleaning head have been in widespread use for cleaning the surface of a large-sized structure such as an oil reservoir tank, a tall building and a ship. Usually, this type of cleaning device includes a closing member defining a pressure-reduction space in cooperation with the surface to be cleaned. The cleaning head is mounted on the closing member, and the tip of the nozzle flow passage is positioned within the pressure-reduction space. A suction means is also provided which draws the fluid from the pressure-reduction space through an outflow passage. By the action of the suction means, the pressure-reduction space is kept in a pressure-reduced condition, and the closing member having the cleaning head mounted thereon is vacuum-attracted to the surface to be cleaned. The cleaning material impinged against the surface from the nozzle flow passage is entrained in a fluid stream sucked from the pressure-reduced space through the outflow passage, and recovered from the pressure-reduced space. The specification, claims and drawings of U.S. Pat. No. 4,095,378 (Japanese Patent Publication No. 26752/1985) may be cited as a typical example of the prior art disclosing conventional cleaning devices.

The cleaning efficiency of the above type of cleaning device depends upon the amount per unit time of the cleaning material impinged against the surface to be cleaned through the nozzle flow passage. Accordingly, in order to increase the cleaning efficiency, it would be appropriate to increase the amount per unit time of the pressure fluid stream containing the cleaning material which is fed to the nozzle flow passage and thereby to increase the amount of the cleaning material to be impinged against the surface to be cleaned. However, to increase the amount of the pressure fluid stream, it is necessary to increase the size of a pressure fluid supply source that can be constructed of a pressure pump or the like, and the equipment and operating costs will increase considerably. It may seem possible to increase the amount of the cleaning material alone without increasing the amount of the pressure fluid stream which is to entrain the cleaning material. If, however, the amount of the cleaning material becomes excessive with respect to the amount of the pressure fluid stream, the cleaning material cannot be smoothly conveyed through a feed passage (which may be made of a flexible hose) extending from a source of supply of the cleaning material to the nozzle flow passage. As a result, the cleaning efficiency is rather reduced and the cleaning material might block up the feed passage.

SUMMARY OF THE INVENTION

It is a primary object of this invention to increase the aforesaid cleaning efficiency by increasing the amount per unit time of the cleaning material to be impinged against the surface to be cleaned without increasing the amount per unit time of the pressure fluid stream to be fed to the nozzle flow passage and therefore without involving a considerable increase in equipment and operating costs.

The essential characteristic feature of the invention for achieving the primary object is that (a) in addition to an upstream nozzle flow passage through which a pressure fluid stream containing a cleaning material is fed, a downstream nozzle having a sufficiently larger sectional area than the sectional area of the upstream nozzle flow passage and adapted to be positioned opposite to a surface to be cleaned is provided apart from the upstream nozzle flow passage in the downstream direction so that the pressure fluid stream containing the cleaning material fed to the upstream nozzle flow passage may be impinged against the surface to be cleaned through the downstream nozzle flow passage; and that (b) in relation to the downstream nozzle flow passage, a re-impinged cleaning material in flow passage and a cleaning material returning means for returning the cleaning material impinged against the surface to be cleaned to the re-impinged cleaning material in flow passage are provided, and a portion of the cleaning material returned to the re-impinged cleaning material in flow passage is sucked to the downstream nozzle flow passage by the sucking action created by the advancing of the cleaning material-containing pressure fluid stream in the upstream nozzle flow passage into the downstream nozzle flow passage, and re-impinged from it against the surface to be cleaned.

According to this invention, there is provided a cleaning device comprising a cleaning head having a first nozzle flow passage to be positioned opposite to a surface to be cleaned, a second nozzle flow passage spaced upstream of the first nozzle flow passage, a re-impinged cleaning material inflow passage and an outflow passage, means for feeding a pressure fluid stream containing a cleaning material to the second nozzle flow passage, means for sucking a fluid from the outflow passage, and means for returning the cleaning material impinged against said surface from the first nozzle flow passage to the re-impinged cleaning material inflow passage;

wherein the cross-sectional area of the first nozzle flow passage is sufficiently larger than that of the second nozzle flow passage; the pressure fluid stream containing the cleaning material which has been fed to the second nozzle flow passage from said cleaning material feed means passes through the second nozzle flow passage, advances into the first nozzle flow passage and is impinged against said surface from the first nozzle passage; this flowing of the pressure fluid stream containing the cleaning material creates a sucking action in the first nozzle flow passage, and a portion of the cleaning material returned to the re-impinged cleaning material inflow passage is sucked into the first nozzle flow passage by the sucking action, and re-impinged against said surface from the first nozzle flow passage while a portion of the remainder of the cleaning material returned to the re-impinged cleaning material inflow passage is entrained by the fluid sucked from the outflow passage.

In the cleaning device of this invention, the amount per unit time of the material to be impinged against the surface to be cleaned is increased by the amount of the re-impinged cleaning material sucked from the first nozzle flow passage (the nozzle passage on the downstream side) from the re-impinged cleaning material inflow passage. This is accomplished without increasing the amount per unit time of the pressure fluid flow to be fed into the second nozzle flow passage (the nozzle flow passage on the upstream side). Since the re-impinged cleaning material sucked into the first nozzle passage is not fed into the second nozzle flow passage but is led to the first nozzle flow passage downstream of the second nozzle flow passage, the flowing of the re-impinged cleaning material does not obstruct the feeding of the pressure fluid flow into the second nozzle flow passage.

DETAILED DESCRIPTION OF PREFERRED EMBODIMENTS

Preferred embodiments of the cleaning device of the invention will be described in detail with reference to the accompanying drawings.

Figure 1:
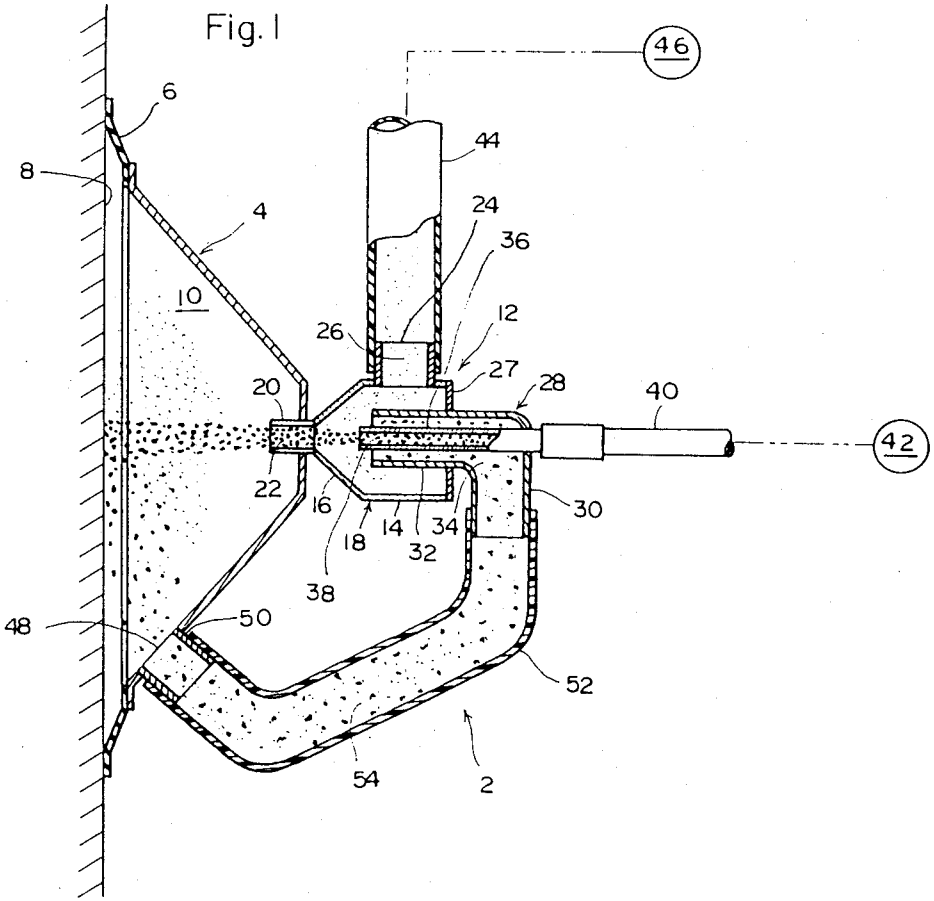
FIG. 1 is a sectional view showing the principal parts of the cleaning device of this invention.

With reference to FIG. 1, the cleaning device shown generally at 2 includes a closing member 4 which may be of a nearly frustoconical shape. The closing member 4 is formed of a rigid material such as a steel plate. A partitioning wall 6 is disposed in the annular free end portion of the closing member 4, and extends forwardly while inclining radially outwardly. The partitioning wall 6 is formed of a flexible material such as natural or synthetic rubber. As FIG. 1 clearly shows, the closing member 4 having the partitioning wall 6 is positioned opposite to a surface 8 to be cleaned by contacting the free end portion of the partitioning wall 6 with the surface 8, and in cooperation with the surface 8, defines a pressure-reduction space 10. As will be described below, the pressure-reduction space 10 is evacuated to maintain it in a pressure reduced condition. The closing member 4 therefore suction-adheres to the surface 8. A plurality of wheels to be contacted intimately to the surface 8 and a driving source (not shown) for driving the wheels are also mounted on the closing member 4. Accordingly, the closing member 4 suction-adheres to, and simultaneously travels along, the surface 8. For details of the suction-adhering and travelling of the closure member 4, see U.S. Pat. No. 4,095,378 cited herein as prior art.

A cleaning head 12 is fixed centrally to the rear side (right side in FIG. 10) of the closing member 4. The cleaning head 12 is constructed, for example, by proper metal working or casting and includes a housing 18 comprised of a cylindrical rear portion 14 and a frustoconical front portion 16. A forwardly projecting cylindrical member 20 is disposed at the front end of the housing 18 and defines a first nozzle flow passage 22. The cylindrical member 20 defining the nozzle flow passage 22 extends through the closing member 4, and the tip of the nozzle flow passage 22 is positioned within the pressure-reduction space 10. An opening is formed in the upper surface of the cylindrical rear portion 14 of the housing 18. A cylindrical member 24 defining a outflow passage 26 is disposed extending upwardly from this opening. A member 28 is disposed in the housing 18 extending through its rear wall 27. The member 28 extends in an L-shape, and has an upstream portion 30 extending upwardly from its inlet end and a downstream portion 32 extending forwardly from the upstream portion 30 through the rear wall 27. The member 28 may have a circular cross-sectional shape, and defines a re-impinged cleaning material inflow passage 34. A cylindrical member 36 of a relatively small diameter is also disposed in the cleaning head 12. The cylindrical member 36 extends from rearwardly of the curved portion of the member 28 (the boundary between the upstream portion 30 and the downstream portion 32) and through the downstream portion 32. The cylindrical member 36 extends concentrically with the cylindrical member 20 and substantially straightforwardly. The cylindrical member 36 defines a second nozzle flow passage 38. Accordingly, in the illustrated embodiment, the first nozzle flow passage 22 and the second nozzle flow passage 38 extend substantially straightforwardly and concentrically with each other. The downstream portion 32 of the re-impinged cleaning material inflow passage 34 extends outwardly of, and concentrically with, the second nozzle flow passage 38. It is critical that the cross-sectional area Sa of the first nozzle flow passage 22 should be sufficiently larger than the cross sectional area Sb of the second nozzle flow passage 38. Preferably, Sa=2 to 8 Sb.

The inlet end (upstream end) of the cylindrical member 36 defining the second nozzle flow passage 38 is connected to cleaning material feed means 42 via a flexible hose 40. The cleaning material feed means 42 may be of a known type, and includes a compressor pump and a source of supplying a cleaning material. It feeds a pressure fluid stream (which may be, for example, a compressed air stream) containing the cleaning material to the second nozzle flow passage 8 through the flexible hose 40. If desired, it is possible to include the cleaning meterial into a liquid such as water instead of the compressed gas stream and thus feed the cleaning material. The inlet end (upstream end) of the cylindrical member 24 defining the outflow passage is connected via the flexible hose 44 to suction means 46 which may be a vacuum pump. The suction means 40 sucks a gas (or a liquid) from the out flow passage 26 through the flexible hose 44. A discharge opening 48 is formed in the closing member 4 which defines the pressure-reduction space 10 in cooperation with the surface 8. A cylindrical member 0 projecting rearwardly from the discharge opening 48 is disposed. The cylindrical member 50 is connected to the inlet end (upstream end) of the the member 28 by means of a pipe 52 (which may be made of a synthetic resin or rubber). The pipe 52 and the cylindrical member 50 constitute a re-impinged cleaning material return passage (return means) 54 for returning the cleaning material, which has been impinged against the surface 8, to the re-impinged cleaning material inflow passage 34 defined by the member 28.

The operation and advantage of the cleaning device described above will now be explained. To clean the surface 8, a pressure fluid stream containing the cleaning material is fed to the second nozzle flow passage 38 from the cleaning material feed means 42 via the flexible hose 40. The compressed fluid stream containing the cleaning material passes through the second nozzle flow passage 38, advances into the first nozzle flow passage, and is impinged against the surface 8 from the first nozzle flow passage 22. In the meantime, the suction means 46 communicating with the outflow passage 26 via the flexible hose 44 sucks the fluid from the pressure-reduction space 10 through the re-impinged cleaning material returning passage 54, the re-impinged material inflow passage 34, the space within the housing 18 and the outflow passage 26. As a result, the space 10 is reduced in pressure. When the pressure fluid stream containing the cleaning material comes into the first nozzle flow passage from the second nozzle passage 38 and flows through the first nozzle flow passage 22, the first nozzle flow passage 22 acts as a mixing chamber in an ejection to create a sucking action at the inlet portion (upstream portion) of the first nozzle flow passage 22. Accordingly, the fluid in the pressure-reduced space 10 is not sucked into the housing 18 via the first nozzle passage 22. The cleaning material which has been impinged against the surface 8 and performed a cleaning action flows through the re-impinged material cleaning material returning passage 54 while being entrained in the fluid flow sucked from the space 10, and is returned to the re-impinged cleaning material inflow passage 34. The returned cleaning material flowing through the flow passage 34 flows into the space within the housing 18 and a portion of it advances into the first nozzle flow passage 22 by its own flowing inertia and the sucking action created at the inlet portion of the first nozzle flow passage 22, and is again impinged against the surface 8. A portion of the remainder of the cleaning material which has been returned to the space within the housing 18 from the re-impinged cleaning material flow passage 34 is entrained by fluid stream sucked through the discharge flow passage 26 and the flexible hose 44 and fluidized. Generally, the cleaning material undergoes breakage by collision with the suface 8 or otherwise. Since the broken cleaning material has a relatively large surface area for its weight and does not much flow by its own inertia, the broken cleaning material tends to be entrained in the sucked fluid stream and drawn through the outflow passage 26 and the flexible hose 44 without entering the first nozzle flow passage 22. On the other hand, the cleaning material which retains its good cleaning properties without breakage has a small surface area for its weight and flows well by its own inertia. Accordingly, it tends to enter the first nozzle flow passage 22. Foreign materials, paints, rust, etc. which are peeled or otherwise removed from the surface are entrained in the fluid stream sucked from the pressure-reduction space 10 and drawn through the re-impinged cleaning material return passage 54, the re-impinging cleaning material flow passage 34 and the outflow passage 26. The flexible hose 44 connected to the outflow passage 26 may be caused to communicate with the suction means 46 via a known mixture separating device (not shown) so that the cleaning material, contaminants, paints, rusts, etc. are separated from the suction fluid stream in the foreign material separating device. The partitioning wall 6 disposed in the closing member 4 makes contact lightly or intimately, but the space between the partitioning wall 6 and the surface 8 is never sealed up tightly. When the inside of the pressure reduction space 10 is maintained under the reduced pressure, some fluid flows into the pressure reduction space 10 from between the partitioning wall 6 and the surface 8.

Accordingly, in the cleaning device 2 of the invention, not only the cleaning material originally contained in the compressed fluid stream fed into the second nozzle flow passage 38 from the cleaning material feed means 42 but also the cleaning material returned to the re-impinged cleaning material inflow passage through the re-impinged cleaning material return passage 54 are impinged against the surface 8 from the first nozzle flow passage 22. Thus, as compared with a conventional cleaning material in which the cleaning material is not re-impinged against the surface 8, the amount of the cleaning material impinged against the surface 8 is increased and thereby the cleaning efficiency is improved.

If the amount of the cleaning material fed to the second nozzle flow passage 38 from the cleaning material feed means 42 is M kg/min., the rate of re-impingement of the cleaning material is R% and the number of re-impingements of the cleaning material is n, the amount of the cleaning material impinged per minute is as follows:

$$F(n)=F(n-1)\times r/100+M$$

Figure 2:
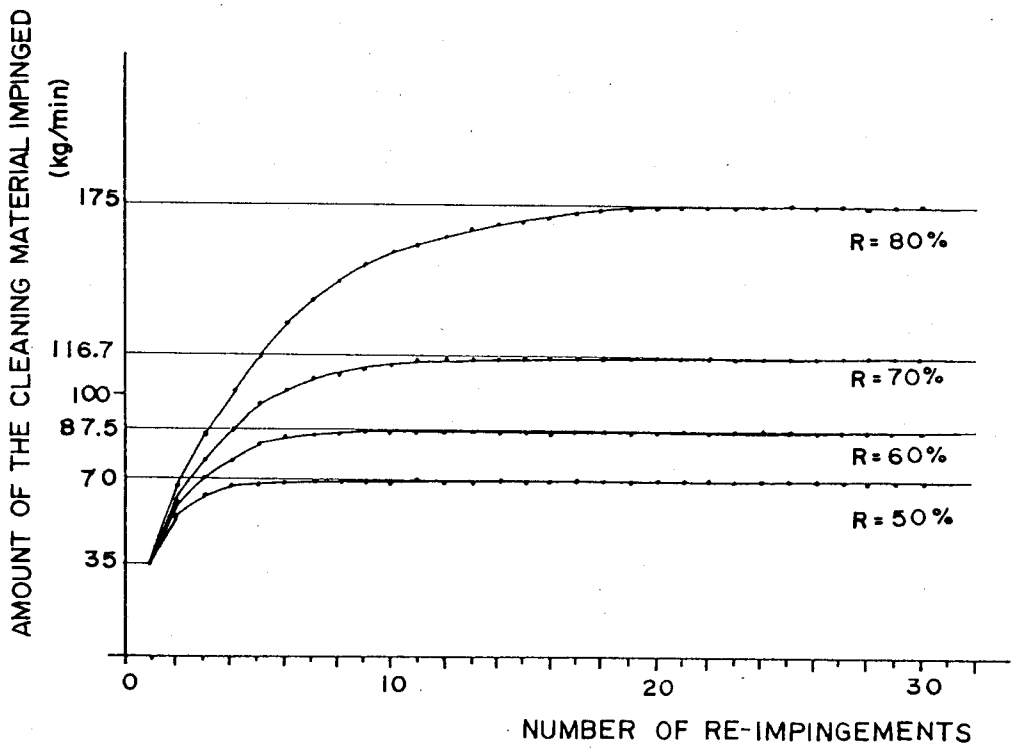
FIG. 2 is a diagram showing variation in the amount of the cleaning material impinged against a surface to be cleaned by the cleaning device of FIG. 1.

FIG. 2 is a diagram showing the variations of the amount of the impinged cleaning material for M=35 and R=50, 60, 70 and 80 respectively, which were calculated by a computer. In FIG. 2, the axis of ordinates indicates the amount of the cleaning material impinged (kg/min. SDD) and the axis of abscissas, the number of re-impingements. It is seen from FIG. 2 that when R is constant, the amount of the cleaning material impinged is stabilized within a specific range if time passes beyond a predetermined period of time. In the cleaning device 2 described above with reference to FIG. 1, the re-impinging rate of the cleaning material can be properly adjusted by, for example, varying the amount of the fluid stream to be sucked from the flow passage 26 by the suction means 46, the amount of the fluid stream to be fed to the second nozzle flow passage 38 from the cleaning material feed means 42, or the distance between the first nozzle flow passage 22 and the second nozzle flow passage.

Figure 3:
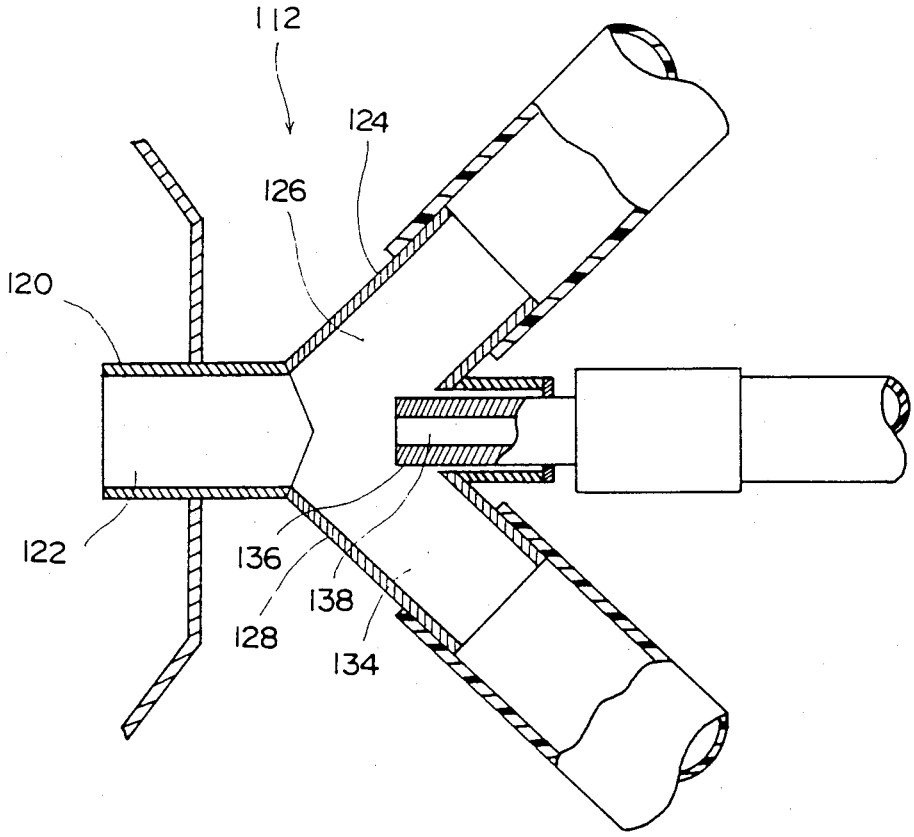
FIG. 3 is a sectional view showing a modified example of a cleaning head in the cleaning device of FIG. 1.

FIG. 3 shows a modified example of the cleaning head. In a cleaning head 112 shown in FIG. 3, a cylindrical member 120 defining the first nozzle flow passage 122 and a cylindrical member 136 defining the second nozzle flow passage 138, as in the embodiment shown in FIG. 1, extend substantially straightforwardly and concentrically with each other with a distance therebetween in the left-right direction in FIG. 3. On the other hand, a cylindrical member 124 defining a flow passage 126 extends inclinedly rearwardly and upwardly from between the upstream end of the first nozzle flow passage 122 and the downstream end of the second nozzle flow passage 138. A re-impinged cleaning material flowing passage 134 is defined by the cylindrical member 128. The cylindrical member 128 extends rearwardly and downwardly from between the upstream end of the first nozzle flow passage 122 and the downstream end of the second nozzle flow passage 138. The other structure of the cleaning head 112 shown in FIG. 3 is substantially the same as the structure of the cleaning head 12 shown in FIG. 1, and therefore, a description of the other structure will be omitted herein.

In the case of using the cleaning head 112 shown in FIG. 3, too, the cleaning material impinged against the surface from the first nozzle flow passage is returned to the re-impinged cleaning material inflow passage 134. Thereafter, a portion of the returned cleaning material again enters the first nozzle flow passage 122, and is again impinged against the surface from the first nozzle flow passage 122. Another portion of the returned cleaning material is discharged while being entrained in the fluid stream sucked through the outflow passage 126.

While the cleaning device of this invention has been described in detail with reference to a preferred embodiment and a modified embodiment shown in the accompanying drawings, it should be understood that the present invention is not to be limited to the preferred and modified embodiments, and various changes and modification are possible without departing from the scope of the invention described and claimed herein.

What I claim is:

1. A cleaning device comprising:

a cleaning head having a first nozzle flow passage with an associated cross-sectional area, to be positioned opposite to a surface to be cleaned, a second nozzle flow passage with an associated cross-sectional area, spaced upstream of the first nozzle flow passage, a re-impinged cleaning material inflow passage and an outflow passage, means for feeding a pressure fluid stream containing a cleaning material to the second nozzle flow passage, means for sucking a fluid from the outflow passage, and means for returning the cleaning material impinged against said surface from the first nozzle flow passage to the re-impinged cleaning material inflow passage:

whereby the pressure fluid stream containing the cleaning material which has been fed to the second nozzle flow passage from said cleaning material feed means passes through the second nozzle flow passage, advances into the first nozzle flow passage and is impinged against said surface from the first nozzle passage;

said cross-sectional area of the first nozzle flow passage being sufficiently larger than that of the second nozzle whereby the flowing of the pressure containing the cleaning material creates a sucking action in the first nozzle flow passage, and a portion of the cleaning material returned to the re-impinged cleaning material inflow passage is sucked into the first nozzle flow passage by the sucking action, and re-impinged against said surface from the first nozzle flow passage while a portion of the remainder of the cleaning material returned to the re-impinged cleaning material inflow passage is entrained by the fluid sucked from the outflow passage.

2. The cleaning device of claim 1 in which the first nozzle flow passage and the second nozzle flow passage extend substantially straightforwardly and concentrically with each other.

3. The cleaning device of claim 1 in which the cross-sectional area of the first nozzle flow passage is 2 to 8 times that of the second nozzle flow passage.

4. The cleaning device of claim 1 in which a downstream end portion of the re-impinged cleaning material inflow passage extends outwardly of, and concentrically with, the second nozzle flow passage.

5. The cleaning device of claim 1 in which the device includes a closing member defining a pressure-reduction space in cooperation with the surface to be cleaned;

the tip of the first nozzle flow passage is positioned within the pressure-reduction space;

the cleaning material return means is comprised of a return flow passage ranging from the pressure-reduction space to the re-impinged cleaning material inflow passage;

the sucking means sucks the fluid from the pressure-reduction space via the return flow passage, the re-impinged cleaning material inflow passage and the outflow passage; and the cleaning material impinged against the surface from the first nozzle flow passage is returned to the re-impinged cleaning material inflow passage while being entrained by the fluid sucked from the pressure-reduction space.

* * * * *